US005296004A

United States Patent [19]

Johnson et al.

[11] Patent Number: 5,296,004

[45] Date of Patent: Mar. 22, 1994

[54] FIRESTARTING PELLET

[76] Inventors: Geoffrey W. A. Johnson; Christopher J. Johnson, both of 25230 NE. 52nd Pl., Redmond, Wash. 98053

[21] Appl. No.: 40,337

[22] Filed: Mar. 31, 1993

[51] Int. Cl.[5] ..... C10L 11/06; C10L 11/04

[52] U.S. Cl. ..... 44/545; 44/502

[58] Field of Search ..... 44/502, 542, 545, 590, 44/451, 603, 533

[56] References Cited

U.S. PATENT DOCUMENTS

| | | | |
|---|---|---|---|
| 186,082 | 1/1877 | Diall | 33/545 |
| 1,924,180 | 8/1933 | Cole | 44/542 |
| 2,170,326 | 8/1939 | Headland | 44/542 |
| 2,531,828 | 11/1950 | Schultz | 44/545 |
| 2,963,352 | 12/1960 | Davis | 44/545 |
| 3,395,002 | 7/1968 | Winnicki et al. | 44/545 |
| 4,244,701 | 1/1981 | Yamashita | 44/502 |
| 4,261,700 | 4/1981 | Monick | 44/542 |

FOREIGN PATENT DOCUMENTS

| | | | |
|---|---|---|---|
| 3041331 | 11/1982 | Fed. Rep. of Germany . | |
| 1439950 | 6/1976 | United Kingdom | 44/545 |

OTHER PUBLICATIONS

Chem. Abstracts 52:728i.

*Primary Examiner*—Prince Willis, Jr.
*Assistant Examiner*—Cephia D. Toomer
*Attorney, Agent, or Firm*—Seed and Berry

[57] ABSTRACT

There is disclosed a firestarting pellet made from cedar and impregnated with an alcohol/water solution. The pellet rapidly ignites combustible fire fuels under a variety of burning conditions. A method of manufacturing the firestarting pellet is also disclosed.

12 Claims, No Drawings

FIRESTARTING PELLET

TECHNICAL FIELD

This invention relates generally to a firestarting composition and, more specifically, to a fire starting pellet which may be readily ignited and maintains combustion to effect rapid fuel ignition.

BACKGROUND OF THE INVENTION

The rising cost of energy has spurred many homeowners to supplement their heating needs with wood burning fireplaces and stoves. The low cost and availability of fuel renders fireplaces and stoves attractive alternatives to complete dependence on conventional energy sources including electricity, gas, and oil.

Efficient fire fuels are readily combustible, burn cleanly, and provide a maximum of heat output. However, most fuels, including wood and charcoal, require the use of ignition expedients, commonly known as firestarters.

Although firestarters may be as simple as wood kindling or paper, slightly more sophisticated products such as wax coated wood chips, pitch soaked wood cubes, fat wood, impregnated cardboard, and gelled alcohol, are common. Because of the cost to produce firestarters, they are not considered to be used as primary fire fuel. Firestarters are designed only to initiate the burn.

The effectiveness of a firestarter may be measured by efficiency in relation to the ignition of fuel in a particular setting. To be effective in a fireplace, a sufficient quantity of firestarter must be supplied to accomplish the relatively slow process of fuel ignition. A wood stove operates similarly, except that once the fuel has been ignited the combustion process may be controlled by the regulation of air intake to the stove. In either case, the quantity of firestarter must be relatively great to effect the eventual ignition of the fuel.

The "pellet" stove is a recent advancement in wood burning technology. The pellet stove was born out of concerns for efficiency and the adverse effect on air quality caused by increasing popularity of wood burning. The pellet stove was designed for efficient wood pellet burning with minimal incomplete combustion by-products. To accomplish high efficiency and complete combustion, the stove consumes a great amount of oxygen. Oxygen may be introduced into the stove with the aid of a fan which induces a draft and turbulence in the stove's burn chamber. The operation of the fan, however, often creates difficulties for firestarters. When the stove is in operation, the turbulence is such that existing firestarters are incapable of maintaining combustion sufficient to ignite the fuel pellets.

Accordingly, there is a need in the art for a firestarter which effects fuel ignition rapidly and efficiently under a variety of burning conditions. In addition, there is a need in the art for methods of manufacturing such effective and efficient firestarters. The present invention fulfills these needs, and provides further related advantages.

SUMMARY OF THE INVENTION

Briefly stated, in one embodiment of the present invention, a firestarting pellet is disclosed. The pellet is made of cedar impregnated with an alcohol/water solution. Prior to impregnation, the cedar pellet has a moisture content of between 5 and 15 percent by weight and a density between 32 and 40 pounds per cubic foot. The alcohol/water solution is between 85 and 99 percent alcohol. In a preferred embodiment, the alcohol is ethanol, and the ethanol/water solution is 95 percent ethanol.

In another embodiment, a method of manufacturing a firestarting pellet impregnated with an alcohol/water solution is disclosed. The method includes the steps of contacting the cedar pellets with the alcohol/water solution to yield impregnated pellets, and removing the impregnated pellets from any residual alcohol/water solution.

Other aspects of the present invention will become evident upon reference to the following detailed description.

DETAILED DESCRIPTION OF THE INVENTION

A firestarting pellet is disclosed which is readily ignitable and effectively initiates fuel combustion under a variety of burning conditions. The firestarting pellet is effective in the turbulent burn chamber of a pellet stove, as well as in less demanding settings, including fireplaces, wood stoves, and barbecues.

Fuel grade wood pellets are generally made from wood shavings and/or chips of fir, hemlock or pine. The process of wood pellet manufacture begins with the drying of the shavings and/or chips. The drying process reduces the moisture content of the shavings and/or chips to about 5 to 6 percent by weight. The dried shavings and/or chips are then ground into a fine mixture by appropriate techniques, such as a hammer mill. The resulting wood particles are subsequently pressed (usually by a roller) through the perforations of a die. The extruded pellets have a uniform diameter and may be sheared to uniform length. A typical pellet is cylindrical in shape, about three quarters of an inch long and has a diameter of about one quarter of an inch. Depending upon the type of wood and the conditions of the above process, the moisture content and density of the resulting pellets generally range from 5 to 6 percent moisture content and 42 to 46 pounds per cubic foot.

In contrast to fuel grade pellets, the firestarting pellets of this invention are made from cedar material, and preferably either yellow or red cedar. Cedar has a unique characteristic uncommon to other softwoods. Unlike other softwoods, the fibers in cedar are intertwined and therefore render cedar especially suitable to the alcohol impregnation process of the present invention.

The firestarting pellets of the present invention require the use of pellets having a particular moisture content and density. Specifically, the pellets must have a moisture content ranging from about 5 to 15 percent by weight (preferably between 7 to 9 percent by weight), and the density of the pellets must range from about 32 to 40 pounds per cubic foot (preferably from between 35 to 39 pounds per cubic foot).

As mentioned above, commercially available fuel pellets are typically produced having a moisture content of between 5 to 6 percent and a density of about 42 to 46 pounds per cubic foot. While these values are suitable for efficient burning and high heat output once ignited, they are not suitable for firestarting due to their relatively high density. Thus, commercially available fuel pellets are not satisfactory pellets for use as firestarting pellets of the present invention.

In the practice of the present invention, cedar pellets having a moisture and density within the above ranges are employed as the starting material for manufacturing the firestarting pellets. Such pellets can be purchased from commercial sources by specifying the wood type (i.e., cedar), moisture content and density. Specifically, cedar pellets are contacted with an alcohol/water solution under appropriate conditions. Suitable alcohols include low molecular weight alcohols, preferably alcohols containing 10 carbons or less. More preferred alcohols include hexanols, pentanols, butanols, propanols, ethanol and methanol. In a most preferred embodiment, the alcohol is ethanol. The alcohol/water solution contains between 85 and 99 percent alcohol, and preferably from 90 and 95 percent alcohol. In a most preferred embodiment, the alcohol/water solution is a 95 percent alcohol solution.

The firestarting pellets of the present invention are manufactured by contacting cedar pellets with an alcohol/water solution under specific temperature and pressure conditions. The method may be carried out at a temperature range between 60° F. and 100° F., and preferably between 82° F. and 92° F. The pressure exerted on the pellets and alcohol/water solution may be approximately atmospheric pressure, and is preferably at a pressure greater than atmospheric pressure. The time of contact between the pellets and alcohol/water solution required for the manufacture of the firestarting pellets will depend on the volume of the pellets as well as the temperature and pressure of the manufacture.

In preferred embodiment, cedar pellets are contacted with an 95 percent ethanol/water solution for 1 hour at about 87° F. under about 2 atmospheres pressure. After removal of the pellets from any residual ethanol/water solution, the ethanol/water impregnated pellets are packaged. The firestarting pellets prepared by this method are effective in initiating fuel combustion under a variety of burning conditions.

The properties of the cedar pellet and alcohol/water solution, and the method of manufacture are interrelated and contribute to the effectiveness of the firestarting pellet of the present invention.

The moisture content of the cedar pellet and the alcohol/water solution is critical to the effective manufacture and performance of the firestarting pellet since water is an essential ingredient in the process of alcohol impregnation of the pellet. The water swells the pellet and facilitates the absorbance of the alcohol. However, if the moisture content of the pellet is too high (greater than 15 percent by weight) the pellet will break down during the impregnation process, and if the moisture content of the pellet is too low (less than 5 percent by weight) the pellet will not swell enough to facilitate the impregnation of a suitable amount of alcohol. Similarly, if the amount of water present in the alcohol/water solution is too great (greater than 15 percent by weight) the pellet will absorb an excessive amount of water, expand, and lose its structural integrity. In contrast, if the water content of the alcohol/water solution is too low (less than 1 percent by weight) the pellet will absorb too little water and the pellet expansion will be insufficient to allow an effective amount of alcohol to be impregnated. In such a case, the resulting pellet will have diminished firestarting utility.

The manufacture of the pellets of the present invention is sensitive to the time of exposure of the pellet to the alcohol/water solution. The pellets must be treated with the solution for a time sufficient to effect alcohol impregnation, but insufficient to induce loss of structural integrity of the pellet. To effect adequate impregnation of alcohol and minimize the exposure time, the temperature and pressure of the alcohol impregnation process may be optimized.

At a temperature lower than about 60° F., the time required for the pellet to absorb sufficient alcohol exceeds the time at which the pellet is stable in the solution. Above about 100° F., pellet breakdown becomes rapid. An increase in pressure exerted on the pellets and solution has a positive effect on the rate of alcohol impregnation of the pellet. At elevated pressure, the time required to produce a pellet containing an effective amount of alcohol is shortened such that no significant pellet breakdown occurs.

The following examples are offered by way of illustration, not limitation.

EXAMPLES

Example 1

In this example, the manufacture of firestarter pellets of the present invention is disclosed.

To 200 pounds of cedar pellets (Johnson Pellet Mills, Sultan, Wash.; moisture content 7–9 percent, density 35–39 pounds per cubic foot in a 55 gallon drum was added 6 to 8 gallons of 95 percent ethanol (Red Brand, Van Waters and Rogers, Kent, Wash.). The temperature of the contents of the drum was adjusted to between 82° F. and 92° F. by means of a water bath. The drum was sealed and the pressure was increased to 3 atmospheres by adding air pressure to the container. After 2 hours, the pressure was released, the drum was unsealed, and the pellets were removed and packaged. The firestarting pellets thus produced contained between about 22 and 25 percent ethanol by weight.

Example 2

In this example, the performance of the firestarting pellets of the present invention is compared to a commercially available gelled alcohol firestarting product.

Firestarting pellets (15 to 20 pellets) of the present invention were placed in the burnpot of a pellet stove. The firestarting pellets were then ignited with a match, the stove door closed, power to the fan motors engaged, and the fuel feed activated. Within 45 seconds, enough heat was generated to ignite the fuel pellets being fed into the burnpot and normal stove operation was commenced.

In contrast, when firestarting gel (Alco-Brite or Forest Paint Gelled Alcohol) was placed in the burnpot on fuel pellets, 3 to 5 minutes of gel burning was required before generating heat sufficient to ignite surrounding fuel pellets being fed into the burnpot. Furthermore, if power to the stove motors was engaged before the 5 minutes required for fuel ignition, the gel burning was extinguished.

Example 3

The firestarting efficiency of the pellets of the present invention was compared to pellets which were not subject to the alcohol/water impregnation method of the present invention. According to the procedure described in Example 2, when the firestarting pellets were replaced with untreated pellets, ignition of neither the pellets nor fuel was achieved.

From the foregoing, it will be appreciated that, although specific embodiments of the invention have been described herein for purposes of illustration, various modifications may be made without deviating from the spirit and scope of the invention. Accordingly, the invention is not limited except by the appended claims.

We claim:

1. A firestarting pellet comprising a cedar pellet impregnated with an alcohol/water solution, wherein the cedar pellet has a moisture content of between 5 and 15 percent by weight and a density between 32 and 40 pounds per cubic foot prior to impregnation and wherein the alcohol/water solution is between 85 and 99 percent alcohol.

2. The firestarting pellet of claim 1 wherein the cedar pellet is red cedar, yellow cedar, or a mixture thereof

3. The firestarting pellet of claim 1 wherein the cedar pellet has a moisture content of between 7 and 9 percent by weight prior to impregnation.

4. The firestarting pellet of claim 1 wherein the cedar pellet has a density between 35 and 39 pounds per cubic foot prior to impregnation.

5. The firestarting pellet of claim 1 wherein the alcohol/water solution is 90 to 95 percent alcohol.

6. The firestarting pellet of claim 1 wherein the alcohol/water solution is 95 percent ethanol.

7. A method of manufacturing firestarting pellets comprising:

contacting cedar pellets with an alcohol/water solution to yield impregnated pellets, wherein the cedar pellets have a moisture content of between 5 and 15 percent by weight and a density between 32 and 40 pounds per cubic foot prior to contact with the alcohol/water solution, and wherein the alcohol/water solution is between 85 and 99 percent alcohol; and removing the impregnated pellets from any residual alcohol/water solution.

8. The method of claim 7 wherein the cedar pellets are red cedar, yellow cedar, or a mixture thereof.

9. The method of claim 7 wherein the cedar pellets have a moisture content of between 7 and 9 percent by weight prior to impregnation.

10. The method of claim 7 wherein the cedar pellets have a density between 35 and 39 pounds per cubic foot prior to impregnation.

11. The method of claim 7 wherein the alcohol/water solution is 90 to 95 percent alcohol.

12. The method of claim 7 wherein the alcohol/water solution is 95 percent ethanol.

* * * * *